US009341351B2

(12) United States Patent
Wang et al.

(10) Patent No.: US 9,341,351 B2
(45) Date of Patent: May 17, 2016

(54) UNIVERSAL MOUNTING SYSTEM FOR POLE MOUNTED AREA LIGHTS

(71) Applicant: Leotek Electronics Corporation, Tao-Yuan County (TW)

(72) Inventors: Shih-Chang Wang, New Taipei (TW); Pin-Hao Hsu, Yangmei (TW); Po-Chang Li, Taoyuan (TW); Chinmau James Hwang, San Jose, CA (US); Hamid Kashani, San Jose, CA (US)

(73) Assignee: LEOTEK ELECTRONICS CORPORATION, Tao-Yuan County (TW)

( * ) Notice: Subject to any disclaimer, the term of this patent is extended or adjusted under 35 U.S.C. 154(b) by 428 days.

(21) Appl. No.: 13/863,215

(22) Filed: Apr. 15, 2013

(65) Prior Publication Data

US 2013/0286638 A1 Oct. 31, 2013

Related U.S. Application Data

(60) Provisional application No. 61/638,442, filed on Apr. 25, 2012.

(51) Int. Cl.

| | |
|---|---|
| ***F21S 8/00*** | (2006.01) |
| ***F21V 19/02*** | (2006.01) |
| ***F21V 15/01*** | (2006.01) |
| ***F21L 4/02*** | (2006.01) |
| ***F21S 8/08*** | (2006.01) |
| ***F21V 17/00*** | (2006.01) |
| ***F21V 17/08*** | (2006.01) |

(52) U.S. Cl.

CPC . *F21V 19/02* (2013.01); *F21L 4/02* (2013.01); *F21S 8/086* (2013.01); *F21V 15/01* (2013.01); *F21V 17/005* (2013.01); *F21V 17/08* (2013.01); *Y10T 29/49002* (2015.01)

(58) Field of Classification Search

CPC ..... F21W 2131/10; F21W 2131/103; F21W 2111/02; F21V 21/116

USPC ..... 362/431

See application file for complete search history.

(56) References Cited

U.S. PATENT DOCUMENTS

| | | | | |
|---|---|---|---|---|
| 3,264,465 A * | 8/1966 | Rex | F21S 8/086 362/382 |
| 4,426,126 A * | 1/1984 | De Vos | F21V 21/03 362/408 |
| 2011/0058368 A1 * | 3/2011 | Shiau | F21S 48/328 362/225 |

* cited by examiner

*Primary Examiner* — William Carter

(74) *Attorney, Agent, or Firm* — Li & Cai Intellectual Property (USA) Office

(57) ABSTRACT

A luminaire and method of installing same on a mounting pole including a housing having a flange and a plurality of LEDs. The flange includes formed therein a plurality of spaced apart holes disposed along a line, a slot disposed along the line, and a central hole disposed along the line and between the slot and the spaced apart holes. The plurality of LEDs are attached to or disposed in the housing. The method includes hanging the luminaire on an upper mounting bolt extending from a mounting pole, sliding the upper mounting bolt along the slot so that a conduit hole and the central hole are at least partially aligned to each other and one of the plurality of spaced apart holes is aligned to a lower mounting hole, and installing a lower mounting bolt through a lower mounting hole and the one spaced apart hole aligned therewith.

7 Claims, 14 Drawing Sheets

| Model Number | Spacing A (inches) | Spacing B (inches) | Model Number | Spacing A (inches) | Spacing B (inches) |
|---|---|---|---|---|---|
| Acculite | 2.00 | 1.00 | Hitek | 4.25 | 2.125 |
| Cooper (M Type) | 4.875 | 2.4375 | Hubbell (MSM, MSQ, MSL, DM, RC, SQ) | 4.0625 | 2.031 |
| Cooper (E Type) | 3.875 | 3.00 | Hubbell (MSS, DSX) | 2.375 | 1.187 |
| Cooper (Z Type) | 4.875 | 2.4375 | KIM (AR, EKG, ET, 5X, VLCC, CCS) | 5.188 | 2.375 |
| Emco | 3.84 | 1.67 | KIM (SAR, SET) | 3.50 | 1.75 |
| Gardco (H, EH, CA, MA, LPS, G types) | 5.38 | 1.67 | LSI | 4.625 | 3.125 |
| Gardco (G18 type) | 3.84 | 1.67 | Sterner | 3.00 | 1.5 |
| GE | 5.438 | -- | Widelight | 2.00 | 1.00 |

FIG. 2
(Prior Art)

UNIVERSAL MOUNTING SYSTEM FOR POLE MOUNTED AREA LIGHTS

RELATED APPLICATIONS

This application claims the benefit of U.S. Provisional Application No. 61/638,442, filed Apr. 25, 2012, and which is incorporated herein by reference.

FIELD OF THE INVENTION

The present invention relates to luminaires for road illumination, and more particularly to a mounting system for such luminaires.

BACKGROUND OF THE INVENTION

Currently, conventional luminaires (i.e. lighting units) for road illumination include HPS or MHI light bulb fixtures mounted to the top of a vertical mounting pole. These luminaires are very energy inefficient compared to state of the art light emitting diode (LED) luminaires. LEDs last longer, and consume much less power. Many communities are replacing conventional luminaires with LED luminaries. However, there are numerous conventional luminaire models and associated pole mounting hole configurations, which can vary widely by brand and/or by region. As illustrated in FIG. 1, most conventional luminaire designs require the mounting pole 2 to have upper and lower mounting holes 4 and 6, with a conduit hole 8 therebetween (through which the power lines run).

One problem with designing LED luminaires for replacing conventional luminaires is that different conventional luminaire models have different spacing configurations for the mounting and conduit holes. Specifically, the distance A between the two mounting holes 4/6, and the distance B between the lower mounting hole 6 and the conduit hole 8, vary among the different conventional models. Therefore, no single LED luminaire with any given mounting hole and conduit hole spacing configuration would be compatible with all the various hole spacings found on existing mounting poles. The table in FIG. 2 illustrates numerous examples of mounting hole spacing configurations among the more popular conventional luminaire models. In addition, some of the conventional luminaires are configured to mount to round mounting poles, while others are configured to mount to square mounting poles (i.e. mounting poles that have a flat mounting surface). Therefore, one conceivably could need as many as 32 different LED luminaire designs just to accommodate the replacement of those conventional luminaire models identified in FIG. 2. One alternative is to provide a single LED luminaire mounting hole configuration, and drill new holes into the mounting pole during each conventional luminaire replacement. However, modifying the mounting pole with each luminaire replacement is time consuming and costly, especially given that the working area is located at the top of a mounting pole high above the road.

There is a need for an LED luminaire design that is compatible with multiple mounting hole configurations.

BRIEF SUMMARY OF THE INVENTION

The aforementioned problems and needs are addressed by the luminaire of the present invention, which includes a housing having a flange and a plurality of LEDs. The flange includes formed therein a plurality of spaced apart holes disposed along a line, a slot disposed along the line, and a central hole disposed along the line and between the slot and the spaced apart holes. The plurality of LEDs are attached to or disposed in the housing.

Another aspect of the present invention is a method of installing a luminaire on a mounting pole. The mounting pole comprises upper and lower mounting holes and a conduit hole disposed therebetween. The luminaire comprises a housing, a plurality of LEDs attached to or disposed in the housing, and a flange attached to or formed as part of the housing. The flange includes formed therein a plurality of spaced apart holes disposed along a line, a slot disposed along the line, and a central hole disposed along the line and between the slot and the spaced apart holes. The method includes installing an upper mounting bolt in the upper mounting hole such that the upper mounting bolt extends from the mounting pole, hanging the luminaire on the upper mounting bolt by inserting the mounting bolt through the slot, sliding the upper mounting bolt along the slot so that the conduit hole and the central hole are at least partially aligned to each other and so that one of the plurality of spaced apart holes is aligned to the lower mounting hole, and installing a lower mounting bolt through the lower mounting hole and the one spaced apart hole aligned therewith.

Another aspect of the present invention is a method of installing a luminaire on a mounting pole. The mounting pole comprises upper and lower mounting holes and a conduit hole disposed therebetween. The luminaire comprises a housing, a plurality of LEDs attached to or disposed in the housing, and a flange attached to or formed as part of the housing. The flange includes formed therein a plurality of spaced apart holes disposed along a line, a slot contiguous with a hole both disposed along the line wherein the hole has a diameter that is greater than a width of the slot, and a central hole disposed along the line and between the slot and the spaced apart holes. The method includes installing an upper mounting bolt in the upper mounting hole such that the upper mounting bolt extends from the mounting pole, installing a nut on the upper mounting bolt, hanging the luminaire on the upper mounting bolt by inserting the mounting bolt and nut installed thereon through the hole and then sliding the upper mounting bolt along the slot, positioning the luminaire relative to the mounting pole such that the conduit hole and the central hole are at least partially aligned to each other and such that one of the plurality of spaced apart holes is aligned to the lower mounting hole, and installing a lower mounting bolt through the lower mounting hole and the one spaced apart hole aligned therewith.

Other objects and features of the present invention will become apparent by a review of the specification, claims and appended figures.

BRIEF DESCRIPTION OF THE DRAWINGS

FIG. 2 is a table illustrating mounting hole and conduit hole spacing configurations for conventional luminaires.

DETAILED DESCRIPTION OF THE INVENTION

The present invention is an LED luminaire that includes a specially designed mounting flange which is compatible with most mounting hole configurations found on existing mounting poles.

Figure 3:
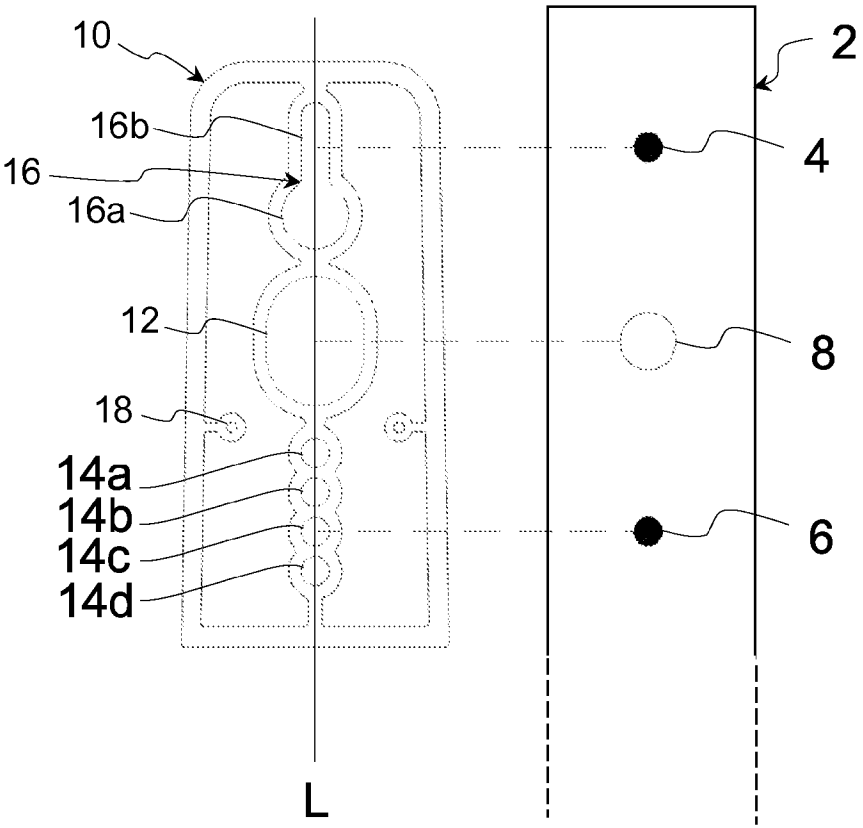
FIG. 3 is an exploded side view of the mounting flange and a mounting pole.

The mounting flange 10 of the present invention is illustrated in FIG. 3, and includes a universal retrofit mounting hole design. The mounting hole design includes a central hole 12 for accommodating the conduit hole 8 in the mounting pole 2 (i.e. through which the electrical conduit for the LEDs runs), a series of individual mounting holes 14*a*, 14*b*, 14*c* and 14*d* for matching with the lower mounting hole 6 on the mounting pole 2, and an elongated slot-hole 16 for matching with the upper mounting hole 4 on the mounting pole 2. The central hole 12, mounting holes 14*a*-14*d* and slot-hole 16 are disposed along a line L. The individual mounting holes 14*a*-14*d* are closely spaced apart, so that for any given mounting pole configuration, at least one of the individual mounting holes 14*a*-14*d* will line up with the lower mounting hole 6 on the mounting pole 2 while allowing sufficient overlap between the central hole 12 and the conduit hole 8 for the conduit to run through. The elongated slot-hole 16 is a combination of a hole 16*a* and a slot 16*b* that is contiguous with, and has a smaller width than, the hole 16*a* (i.e. the width of the slot 16*b* is smaller than the diameter of the hole 16*a*). The slot 16*b* is long enough so that it will line up with the upper mounting hole 4 on the pole 2 when the central hole 12 is aligned to the conduit hole 8 (i.e. slot 16*b* has a length that is at least as great as the range of variations in the distance between upper hole 4 and conduit hole 8 of the mounting poles 2 for which the mounting flange 10 will be compatible). By having at least one of the mounting bolts (i.e. the lower mounting bolt) going through an individual mounting hole (e.g. one of holes 14*a*-14*d*) instead of a slot, it prevents the unwanted vertical sliding of the luminaire should both mounting bolts come loose over time, which could sever or electrically short the conduit running through the central hole 12 and conduit hole 8.

Figure 1:
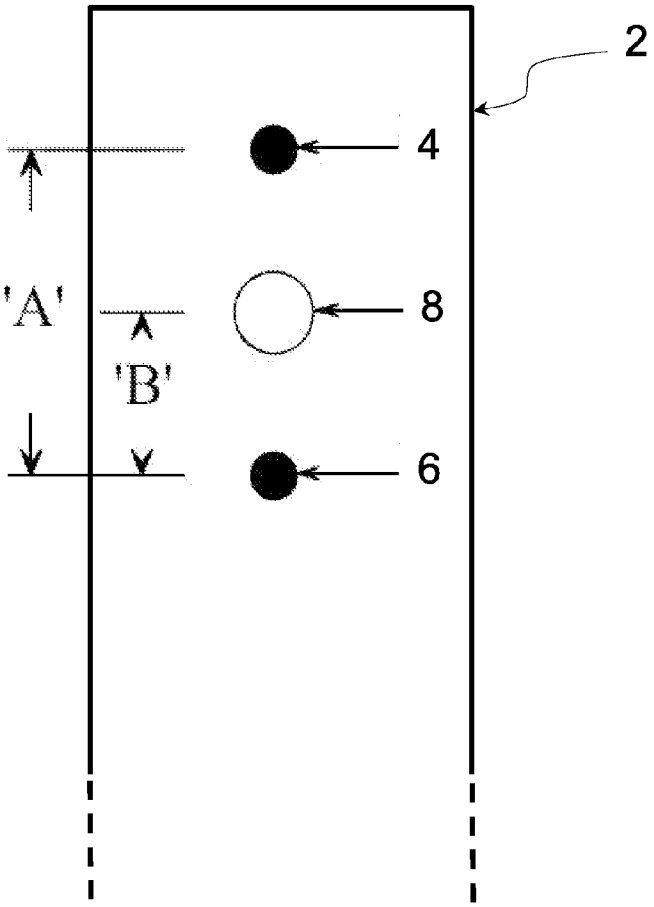
FIG. 1 (Prior Art)
FIG. 1 is a side view illustrating the mounting and conduit holes in a mounting pole for a conventional luminaire.
Figure 4:
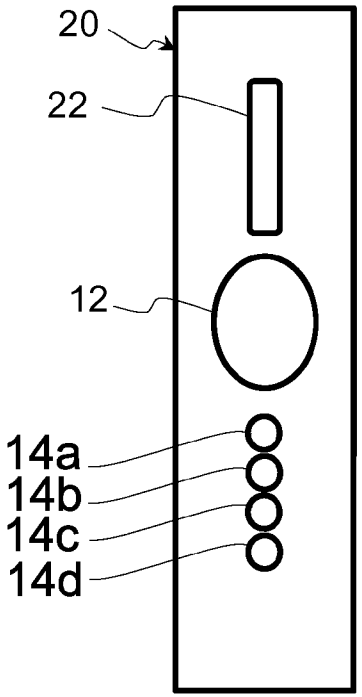
FIG. 4 is a side view of the back plate.

FIG. 4 illustrates an optional back plate 20 that includes the same mounting hole configuration as the mounting flange 10, except it includes a slot 22 instead of slot-hole 16. Back plate 20 can be placed within the mounting pole 2 for receiving and securing the mounting bolts (i.e. for extra structural support). The mounting holes 14*a*-14*d* of back plate 20 can be threaded for receiving the bolt extending through the corresponding hole 14*a*-14*d* of the mounting flange 10 (which would avoid the need for a separate nut). It is preferable to use threaded holes in the back plate 20 instead of threading mounting hole 6 of pole 2 in case the threads get stripped (i.e. easier to replace back plate 20 than re-thread hole 6).

Figures 5A, 5B, 5C:
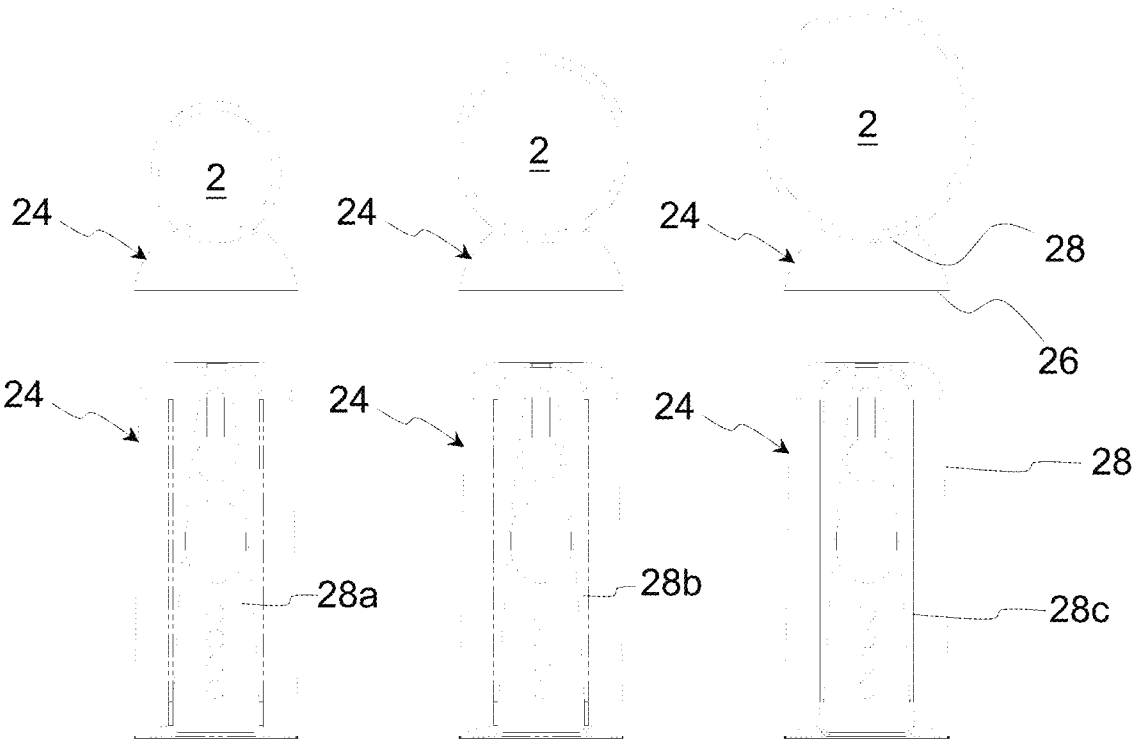
FIG. 5A is a side view of the round pole adaptor and a corresponding top view of the round pole adapter abutting a small diameter mounting pole.
FIG. 5B is a side view of the round pole adaptor and a corresponding top view of the round pole adapter abutting a medium diameter mounting pole.
FIG. 5C is a side view of the round pole adaptor and a corresponding top view of the round pole adapter abutting a large diameter mounting pole.

FIGS. 5A-5C illustrate an optional round pole adapter (RPA) 24, which is a plate member having the same mounting hole design as the mounting flange 10. RPA 24 includes a flat front surface 26 (i.e. compatible with the mounting flange 10), and a curved back surface 28 (i.e. compatible with the round surface of the mounting pole). The RPA 24 allows for a more secure mounting of the flat mounting flange 10 to the curved surface of mounting pole 2. FIGS. 5A-5C illustrate that the RPA 24 is compatible with mounting poles 2 of different diameters (i.e. different portions of the RPA back surface 28 are utilized in an abutting fashion with the pole surface). Specifically, the back surface 28 includes a center portion 28*a* of greater curvature for engaging with smaller diameter poles, a middle portion 28*b* of lower curvature for engaging with medium diameter poles, and a rim portion 28*c* for engaging with larger diameter poles. The mounting flange 10 and RPA 24 can be bolted together (with front surface 26 abutting the mounting flange 10) before installation on the mounting pole using mounting holes 18 on the mounting flange 10.

Figure 6:
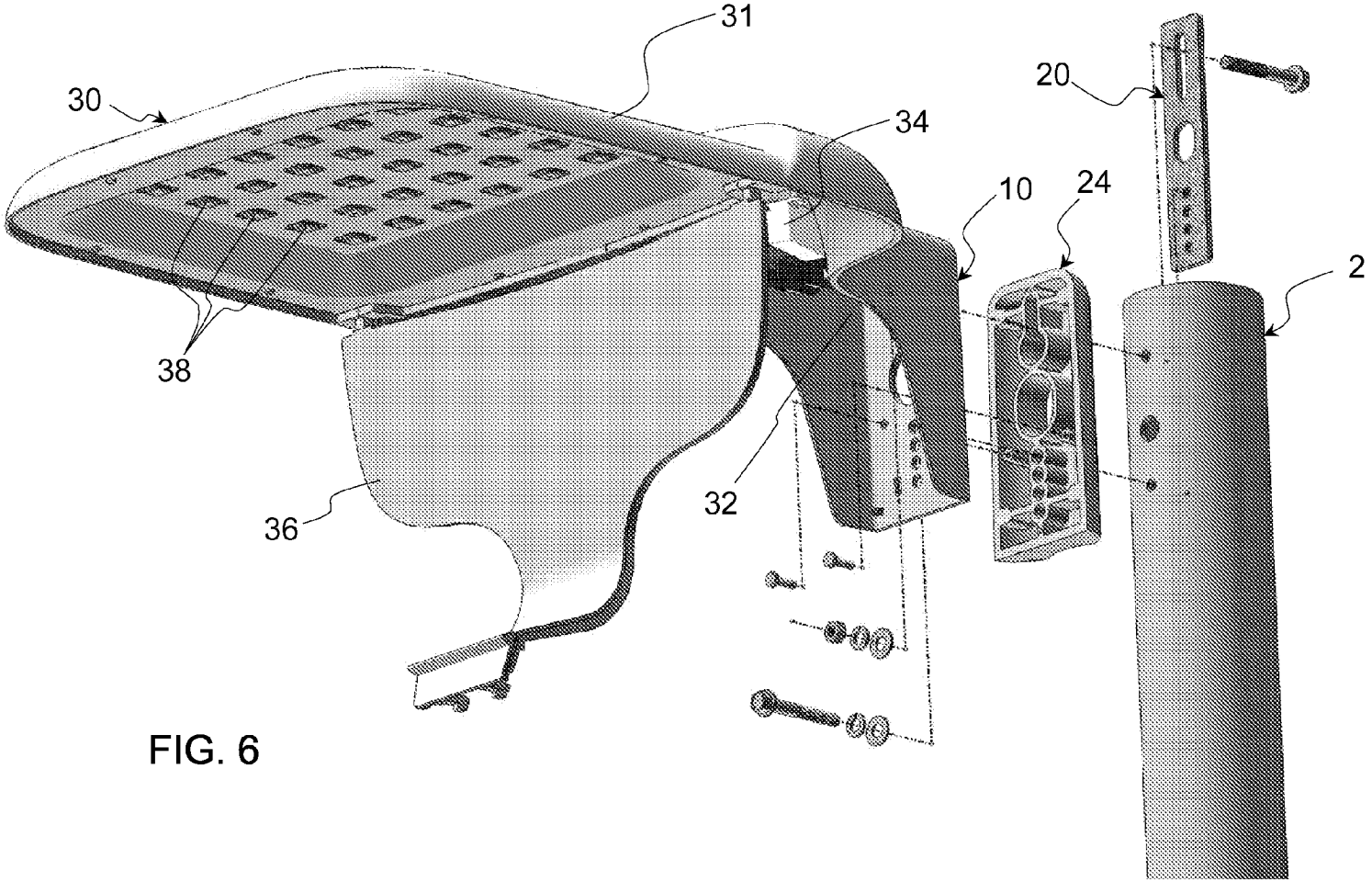
FIG. 6 is an exploded perspective view of the luminaire, round pole adaptor, round mounting pole and back plate.
Figure 7:
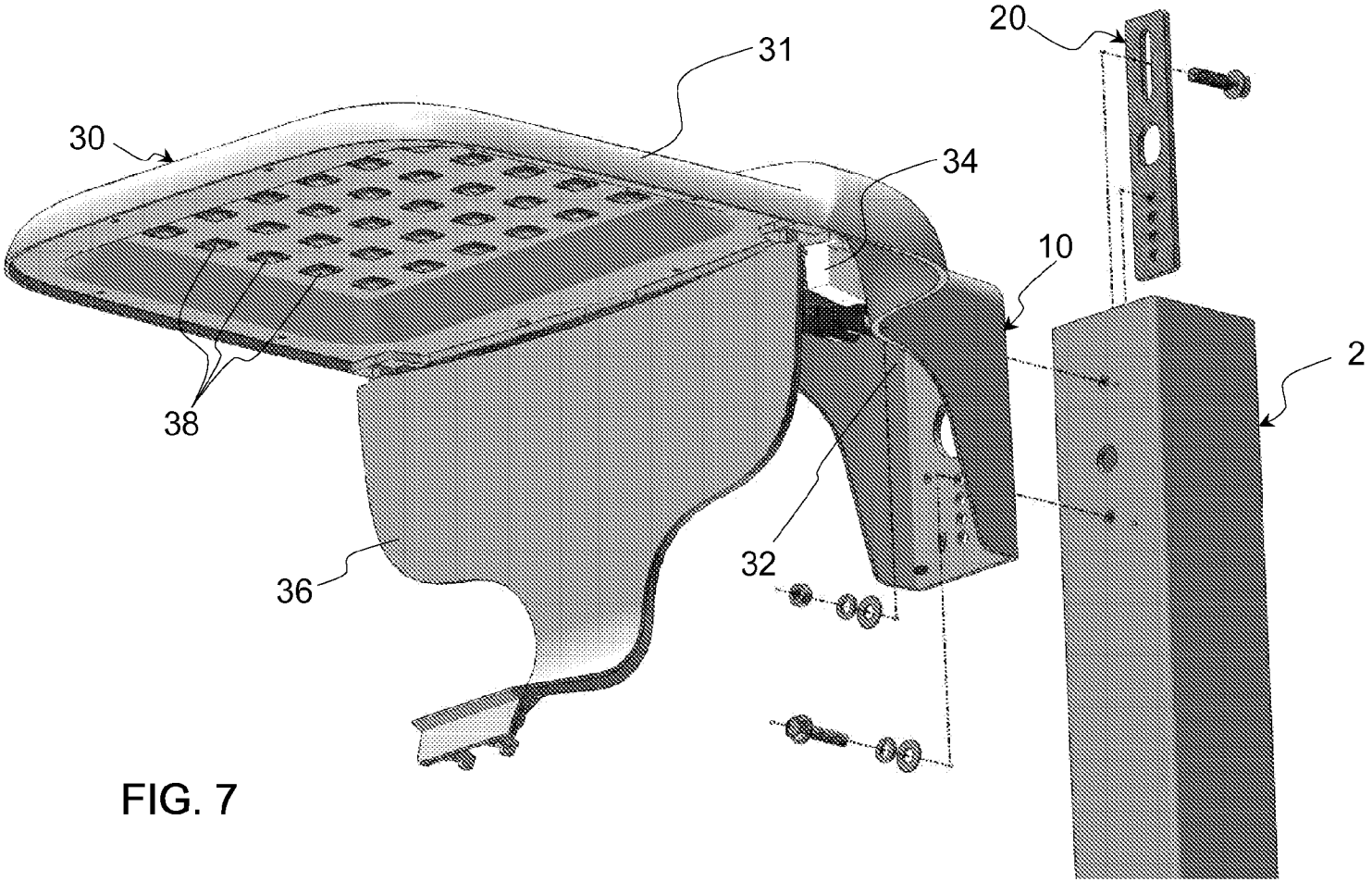
FIG. 7 is an exploded perspective view of the luminaire, square mounting pole and back plate.

FIG. 6 illustrates the installation of the LED luminaire 30 onto a round mounting pole 2 using an RPA 24 and a back plate 20. The LED luminaire 30 includes a mounting flange 10 integrally formed as part of the housing 31, a power supply compartment 32, a power supply 34, a power supply compartment door 36, and a plurality of LEDs 38 contained within or attached to housing 31. FIG. 7 illustrates the installation of the same LED luminaire 30 onto a square mounting pole 2 using a back plate 20.

Figure 8:
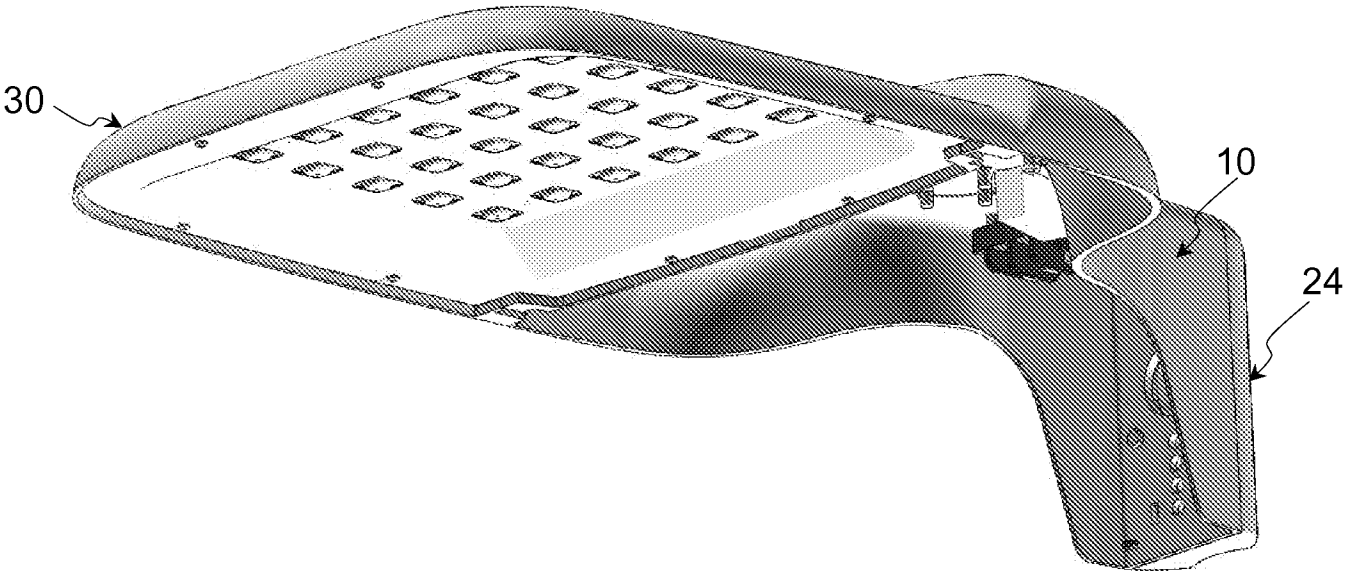
FIG. 8 is a perspective view illustrating the round pole adaptor mounted to the mounting flange of the luminaire.
Figure 9B:
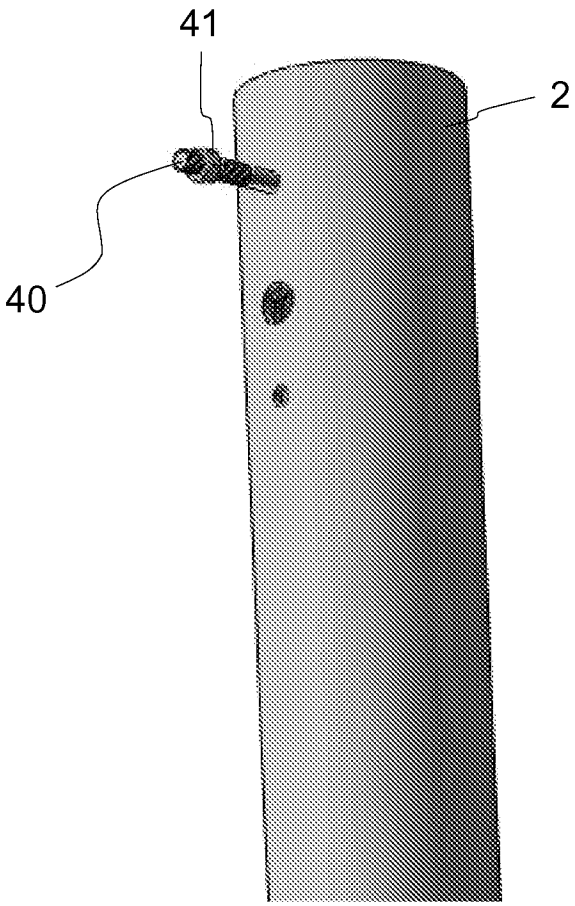
FIG. 9B is a side view illustrating the upper mounting bolt extending from the upper mounting hole of the mounting pole.
Figure 9A:
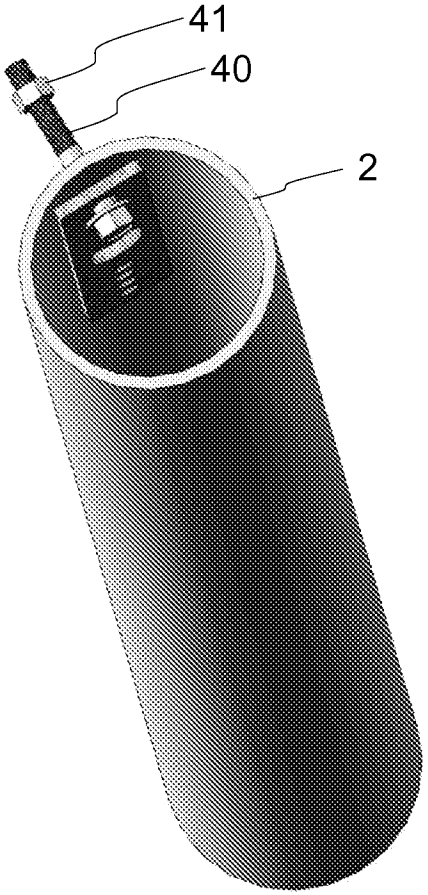
FIG. 9A is a perspective view illustrating the back plate mounted inside the mounting pole with the upper mounting bolt.
Figure 10:
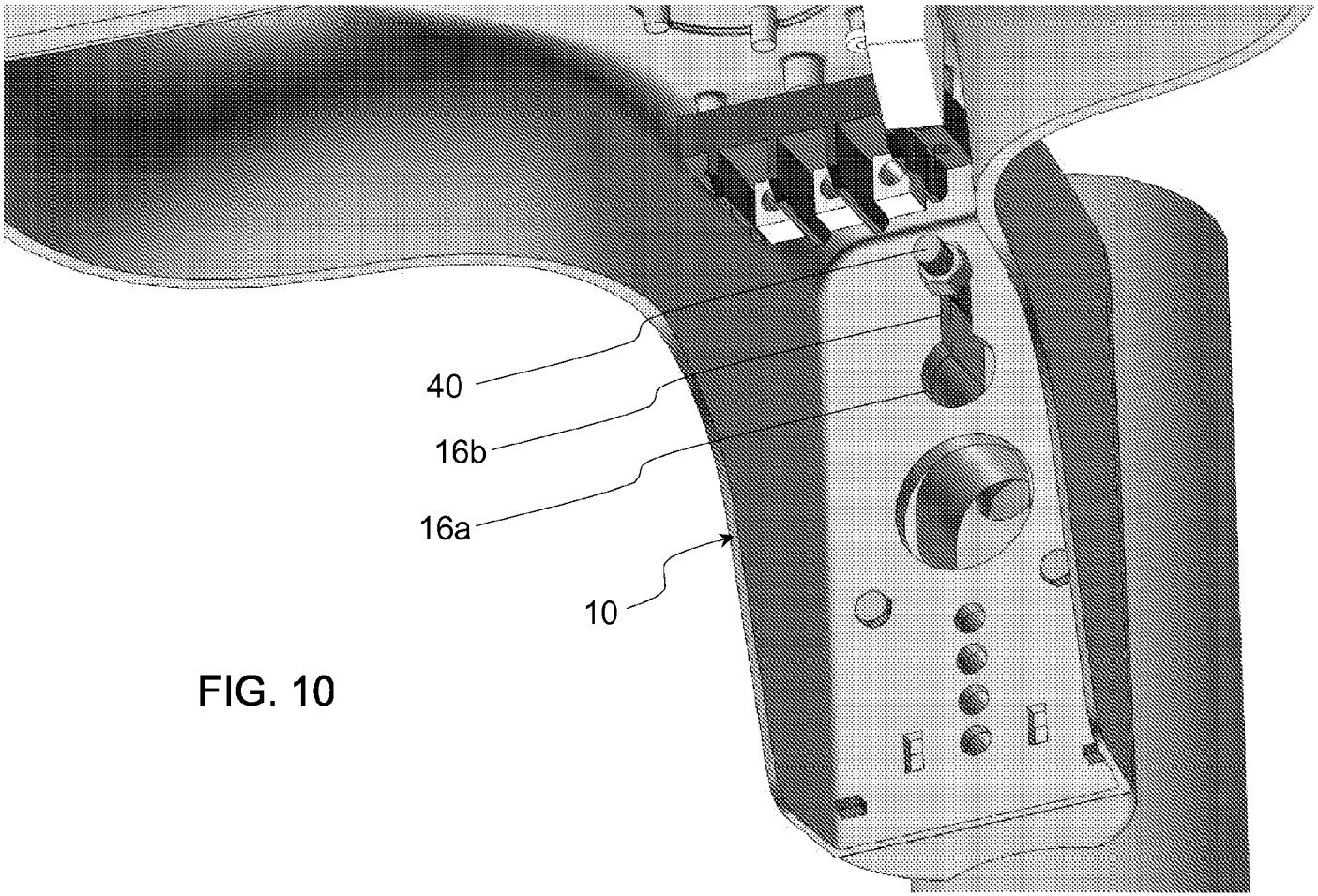
FIG. 10 is a perspective view illustrating the luminaire installed on the upper mounting bolt.

The installation of the LED luminaire 30 onto pole 2 is now described. First, the power compartment door 36 is opened or removed. Then, the optional RPA 24 can be mounted to the mounting flange 10 should it be desired and should the mounting pole be round, as shown in FIG. 8. If the luminaire is going to be mounted to a square pole 2, or if it is deemed unnecessary, optional RPA 24 can be omitted. An upper mounting bolt 40 is installed on mounting pole 2 by extending bolt 40 through slot 16*b* of back plate 20 (if a back plate 20 is used) and through upper mounting hole 4 of pole 2, as illustrated in FIGS. 9A and 9B. A nut 41 is placed on or near the end of the bolt 40 as shown. The luminaire is then hung on the upper mounting bolt 40 via the elongated slot 16*b* of mounting flange 10, as illustrated in FIG. 10. The hole 16*a* is large enough for the nut 41 on the upper mounting bolt 40 to pass through, so that the luminaire 30 can be hung loosely but securely on the upper mounting bolt 40 by passing the bolt 40 and the nut 41 thereon through the hole 16*a* and then sliding the luminaire down until the bolt 40 reaches the top end of the slot 16*b* (i.e. the slot is narrower that the nut 41 so the nut cannot pass through the slot, thus securing the luminaire to the pole in a single action). This allows a single person to conveniently install the luminaire 30. It also frees up both hands of the installer at this stage of the installation so that they can work on the wiring and/or lower bolt installation without having to support or otherwise hold the luminaire 30 in place.

Figure 11:
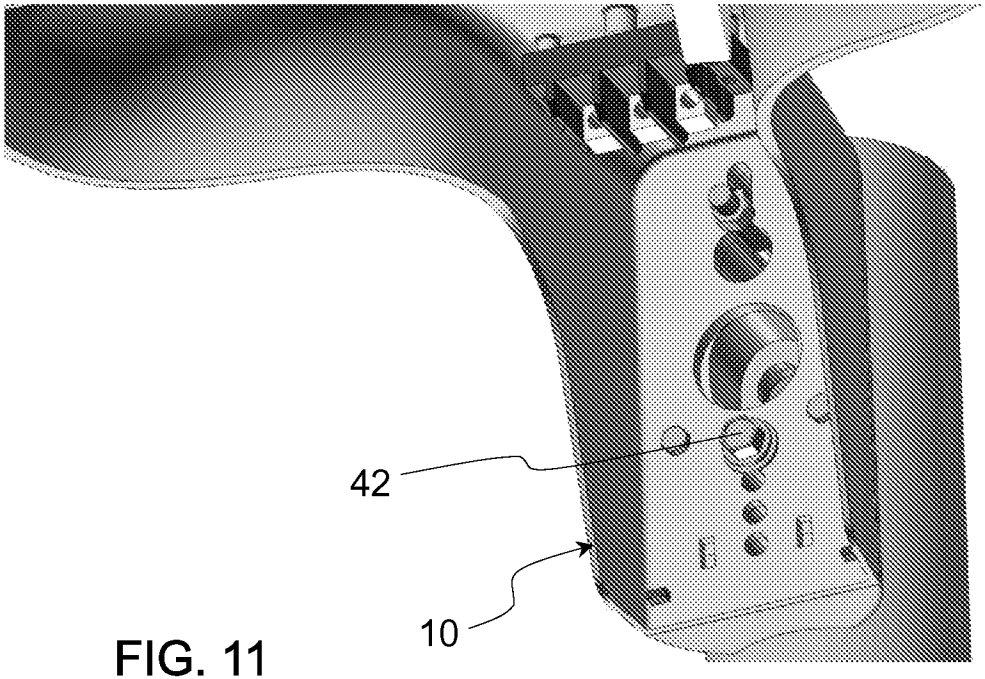
FIG. 11 is a perspective view illustrating the luminaire installed on the upper mounting bolt with its central hole aligned with the conduit hole, and the lower mounting bolt installed.
Figure 12:
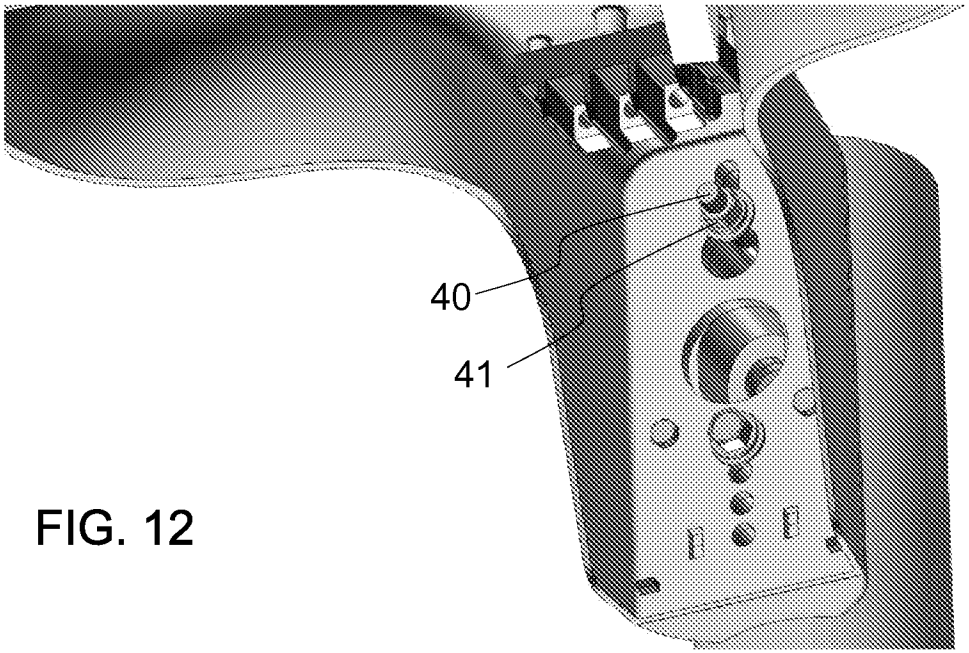
FIG. 12 is a perspective view illustrating the luminaire installed on the upper mounting bolt and the lower mounting bolt.
Figure 13:
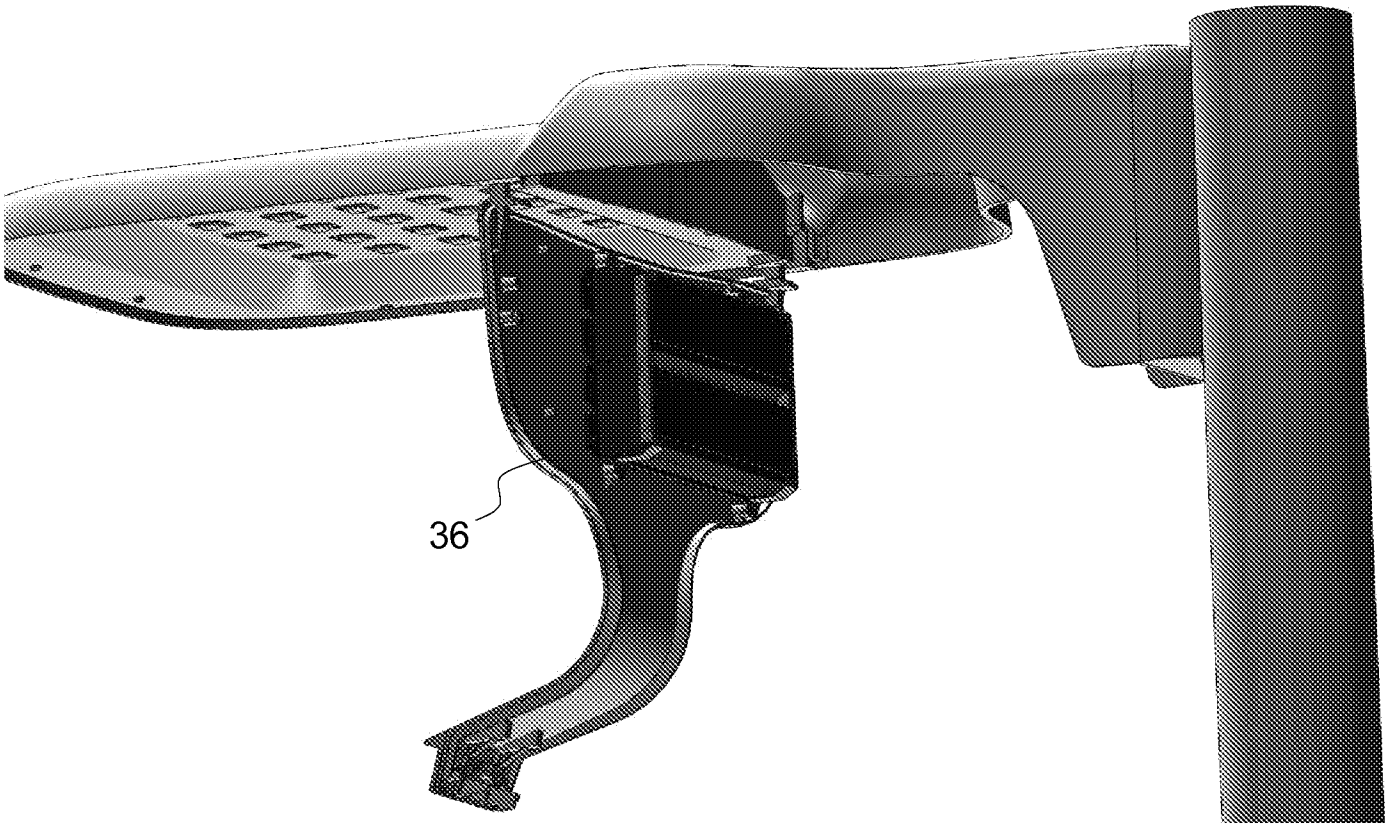
FIG. 13 is a side perspective view illustrating the power supply compartment door installed an in an open position.
Figure 14:
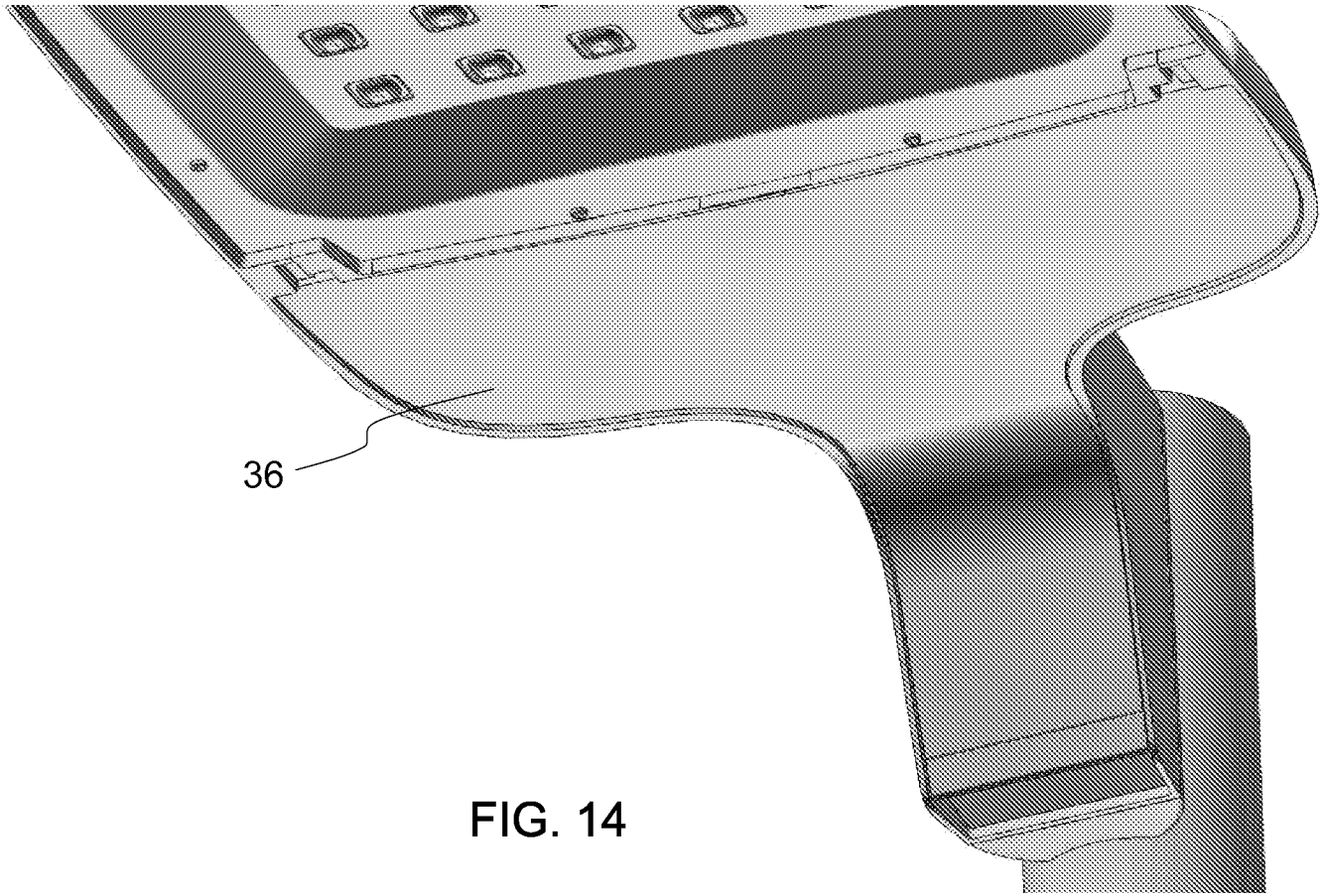
FIG. 14 is a front perspective view illustrating the power supply compartment door installed an in a closed position.

To finish securing the luminaire 30 to the pole 2, the luminaire 30 is slid upwardly so that central hole 12 of mounting flange 10 is at least partially aligned with conduit hole 8 of pole 2, and so that one of the individual mounting holes 14*a*-14*d* is aligned to the lower mounting hole 6 of the pole 2. Then, a lower mounting bolt 42 is inserted through the one aligned individual mounting hole and secured to the pole via lower mounting hole 6 and the corresponding threaded hole in the back plate 20, as shown in FIG. 11. When bolt 42 is tightened, luminaire is held in place. The nut 41 on the upper mounting bolt 40 can be removed and replaced along with a washer and lock washer if desired, without having to manually support the luminaire 30 in place, as shown in FIG. 12. Alternately, nut 40 could be tightened down before the lower mounting bolt 42 is installed. Once the electrical power wiring is connected, the power compartment door 36 can be installed (see FIG. 13) and closed (see FIG. 14).

Figure 16:
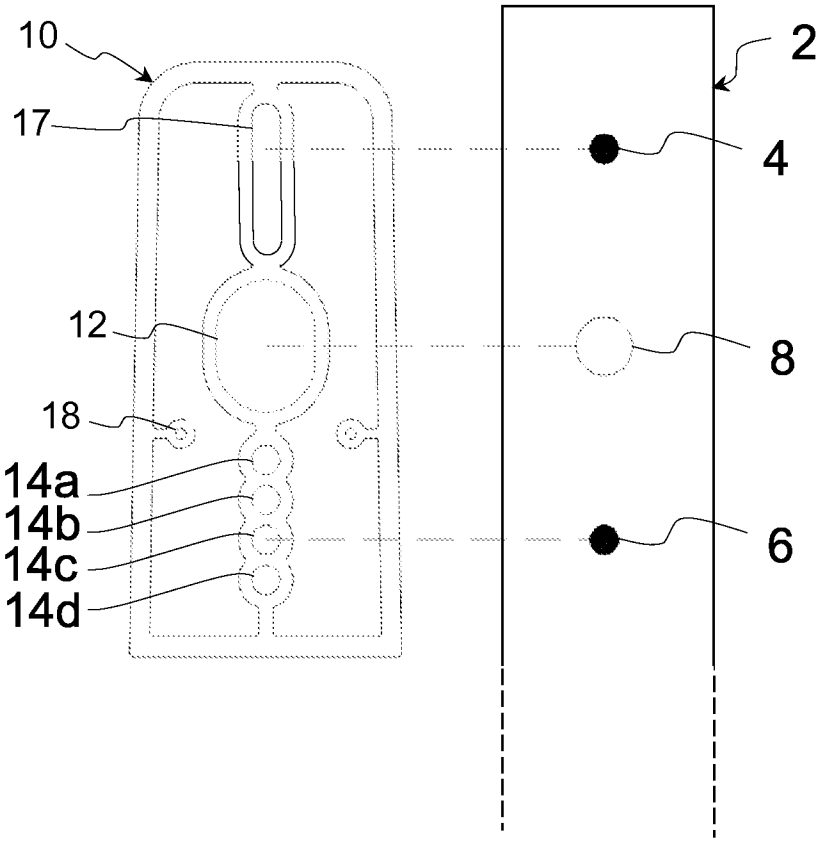
FIG. 16 is an exploded side view of an alternate embodiment of the mounting flange and a mounting pole.
Figure 15:
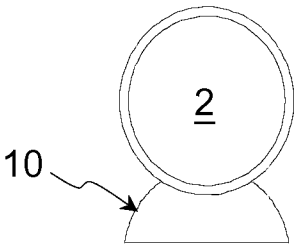
FIG. 15 is top view of an alternate embodiment of the mounting flange.

It is to be understood that the present invention is not limited to the embodiment(s) described above and illustrated herein, but encompasses any and all variations falling within the scope of the appended claims. For example, references to the present invention herein are not intended to limit the scope of any claim or claim term, but instead merely make reference to one or more features that may be covered by one or more of the claims. While mounting flange 10 is illustrated as being integral with the luminaire housing 31, it could be attached thereto as a separate piece. While four mounting holes 14*a*-14*d* are shown, a greater or fewer number could be included. RPA 24 could be integrally formed as part of the mounting flange 10 (i.e. surface of flange 10 facing the mounting pole can be curved), as illustrated in FIG. 15. Lastly, slot-hole 16 could instead be just a slot 17, as shown in FIG. 16, which is less preferable because it would require the installation of nut 41 after the luminaire 30 is hung on bolt 40.

What is claimed is:

1. A luminaire comprising:

a housing having a flange, wherein the flange includes formed therein:

a plurality of spaced apart holes disposed along a line, a slot disposed along the line, and a central hole disposed along the line and between the slot and the spaced apart holes;

a plurality of LEDs attached to or disposed in the housing, and a plate member mounted to the flange, wherein the plate member includes:

a curved surface, a plurality of spaced apart holes formed in the curved surface and aligned to the plurality of spaced apart holes in the flange, a slot formed in the curved surface and aligned to the slot of the flange, and a central hole formed in the curved surface and aligned to the central hole of the flange.

2. The device of claim 1, wherein the flange is formed integrally with the housing.

3. The device of claim 1, wherein the housing defines a power supply compartment.

4. The device of claim 3, further comprising:

a power supply disposed in the power supply compartment and electrically connected to the plurality of LEDs.

5. The device of claim 3, further comprising:

a door removably covering the power supply compartment.

6. The device of claim 1, further comprising:

a hole formed in the flange contiguously with the slot, wherein the hole has a diameter that is greater than a width of the slot, and wherein the hole is disposed along the line.

7. The device of claim 1, wherein the flange includes a curved surface through which the plurality of spaced apart holes, the slot and the central hole are formed.

* * * * *